US006731898B1

(12) United States Patent
Landa et al.

(10) Patent No.: US 6,731,898 B1
(45) Date of Patent: May 4, 2004

(54) INTERLEAVED TANDEM PRINTER AND PRINTING METHOD

(75) Inventors: Benzion Landa, Nes-Ziona (IL); Itzhak Kent, Nes-Ziona (IL); Ilan Meiri, Yavne (IL)

(73) Assignee: Hewlett-Packard Indigo B.V., Maastricht (NL)

( * ) Notice: Subject to any disclaimer, the term of this patent is extended or adjusted under 35 U.S.C. 154(b) by 0 days.

(21) Appl. No.: 09/914,196

(22) PCT Filed: Feb. 6, 2000

(86) PCT No.: PCT/IL00/00077

§ 371 (c)(1),
(2), (4) Date: Aug. 21, 2001

(87) PCT Pub. No.: WO01/56802

PCT Pub. Date: Aug. 9, 2001

(51) Int. Cl.[7] ..... G03G 15/01; B41F 11/02

(52) U.S. Cl. ..... 399/298; 101/139; 101/170; 101/181; 101/182; 430/42

(58) Field of Search ..... 399/179, 223, 399/298, 302, 308, 309, 304, 384, 387, 299; 347/41, 43, 172, 173; 400/82, 120.16; 101/181, 182, 183, 247, 248

(56) References Cited

U.S. PATENT DOCUMENTS

| | | | | | |
|---|---|---|---|---|---|
| 4,108,067 | A | * | 8/1978 | Werner | 101/224 |
| 4,198,642 | A | | 4/1980 | Gamblin | 347/41 |
| 4,240,346 | A | * | 12/1980 | Landis et al. | 101/139 |
| 4,410,897 | A | | 10/1983 | Moriguchi et al. | 347/173 |
| 5,251,989 | A | * | 10/1993 | Di Luco | 400/240.3 |
| 5,299,496 | A | * | 4/1994 | Martin et al. | 101/181 |
| 5,332,642 | A | * | 7/1994 | Simms et al. | 101/425 X |
| 5,570,633 | A | * | 11/1996 | Schultz et al. | 101/182 |
| 5,752,776 | A | | 5/1998 | Kunreuther | 400/82 |
| 5,765,081 | A | * | 6/1998 | Bogaert et al. | 399/299 |
| 5,837,408 | A | * | 11/1998 | Parker et al. | 399/179 X |
| 5,961,228 | A | | 10/1999 | Ward et al. | 400/120.16 |
| 6,022,186 | A | * | 2/2000 | Crowley | 414/796.1 |
| 6,047,156 | A | * | 4/2000 | De Bock et al. | 399/298 |
| 6,185,399 | B1 | * | 2/2001 | Zhao et al. | 399/223 |

FOREIGN PATENT DOCUMENTS

| | | |
|---|---|---|
| EP | 0 813 971 | 12/1997 |
| EP | 0 878 311 | 11/1998 |
| WO | WO 93/01531 | 1/1993 |
| WO | WO 95/10801 | 4/1995 |
| WO | WO 99/61958 | 12/1999 |
| WO | WO 01/02910 | 1/2001 |
| WO | WO 01/53895 | 7/2001 |

* cited by examiner

*Primary Examiner*—Hoan Tran
(74) *Attorney, Agent, or Firm*—Fenster & Company

(57) ABSTRACT

A method of printing utilizing a plurality of printers, each capable of printing an image on a same side of a web, the method comprising: printing, by a first printer, of first images, separated by spaces, along a first side of a web; and printing, by a second printer, of second images at spaced positions within the spaces between the first images on the first side.

32 Claims, 4 Drawing Sheets

INTERLEAVED TANDEM PRINTER AND PRINTING METHOD

RELATED APPLICATIONS

The present application is a U.S. national application of PCT/IL00/00077, filed Feb. 6, 2000.

FIELD OF THE INVENTION

The invention relates to tandem printing and in particular to digital tandem printing systems.

BACKGROUND OF THE INVENTION

As used herein, the term "printing engine" denotes a device which prints at least a ingle color on a substrate. The term "printer" denotes a device that prints all of the (one or more) color separations for a particular image on a substrate. A printer may include a single printing engine or it may include a number of printing engines. The term "one-shot" printer denotes a printer that forms a plurality of color separations on a surface and transfers all of the color separations to the substrate at the same time. "Tandem printers" are printers that have a series of printers or printing engines through which the substrate passes sequentially for printing.

In general, two types of tandem systems are used. A first such system prints each successive color separation of a color image sequentially, utilizing separate printing engines, for each color. In many such systems the separate stations are in separate units. A second type of tandem system is a "duplex" printing system in which one printer is used to print one side of a substrate and a second printer is used to print the other side of the substrate. The first and second printing stations may contain single engines or may have multiple stations for printing multiple separations sequentially. Many tandem printing systems utilize webs as the substrate. In some systems, a plurality of engines print the separations for an image on one side of the substrate and another plurality of engines that print on the other side.

The term "digital printer" is used for a printer in which the image content can be changed between image printings. In particular, the term includes electrostatographic printers such as liquid toner and powder toner electrostatic and electrophotographic printers, ink-jet printers and other printers that electronically determine the printed image.

PCT application PCT/IL98/00553, which is incorporated herein by reference, describes a one-shot digital printing station in which multiple separations are sequentially formed and transferred to an intermediate transfer member and then, transferred from the transfer member to a substrate. One shot printing stations are very suitable for tandem printing and for web printing.

SUMMARY OF THE INVENTION

An aspect of some preferred embodiments of the invention is concerned with printing of series of patterns of images along the length of a web.

In a preferred embodiment of the invention a plurality of printers engines print on a web that passes through the stations. In a preferred embodiment of the invention, a group of printers each prints a complete image on a same side of the web. In particular, different printers print on sequential portions of the web. In an especially preferred embodiment of the invention two or more one-shot printers are utilized for printing on the same side of the substrate.

Some preferred embodiments of the invention deal with duplex printing. A first printer, or group of printers prints on a first side of the web. A second printer or group of printers print on the reverse side of the web. At least one of the sides is printed by two or more printers In preferred embodiments of the invention a first one of the printers prints a series of spaced images on one side of the substrate. A second printer prints spaced images interleaved between the images printed by the first printer. In some embodiments more than two printers are used to print on a single side of the substrate and a higher degree of interleaving may be used.

Preferably, images are printed on the second side of the substrate by a further group of tandem printers, which operate in the same manner as the first and second printers described in the previous paragraph.

In some preferred embodiments of the invention, the printed images are all the same size and are all printed on the same repeat. In others, the size of the images and the repeat are different.

In preferred embodiments of the invention, the separate printers are digital printers, although analog printers (with fixed images) may be used in some embodiments of the invention. When digital printers are used, the size and content of the images is easily controlled and series of images can be printed. In some embodiments all the images printed may be different and/or may have a different size.

There is thus provided, in accordance with a preferred embodiment of the invention, printing apparatus comprising:

- a first printer that prints first images at spaced positions, separated by spaces, along a first side of a web; and
- a second printer that prints second images at spaced positions within the spaces between the first images.

In a preferred embodiment of the invention, in which spaces remain after printing said first and second images, the apparatus includes a third printer that prints third images at spaced positions within the remaining spaces.

Preferably the apparatus includes at least one reverse side printer that prints images on the other side of the web. In a preferred embodiment of the invention the at least one reverse side printer comprises:

- a first reverse side printer that prints images at spaced positions, separated by spaces, along the reverse side of the web; and
- a second reverse side printer that prints images at spaced positions within the spaces between the images printed by the first reverse side printer.

In a preferred embodiment of the invention in which spaces remain after printing by said first and second reverse side printers, the at least one reverse side printer comprises a third reverse side print that prints images at spaced positions within the remaining spaces.

Preferably, the images printed by the at least one reverse side printer are aligned with respective ones of the images printed on the first side of the web.

In a preferred embodiment of the invention, the images printed by the first and second printers have different dimensions along the length direction of the web. In preferred embodiment of the invention, different images printed by at least one of the first and second printers have different dimensions in the led direction of the web. In a preferred embodiment of the invention, at least some of the images printed by at least one of the printers are different from e other. In a preferred embodiment of the invention, at least some of the images produced by different printers are different.

In a preferred embodiment of the invention, the images printed by at least some of the printers are multi-color images comprised of a plurality of single color separations. Preferably, each of the separations is sequentially produced and the apparatus includes an intermediate transfer member that sequentially receives the separations and transfers them together to the web.

Preferably, the printers are electrostatographic printers, preferably utilizing either powder or liquid toner.

In a preferred embodiment of the invention, the first and second printers are identical in structure.

In a preferred embodiment of the invention, at least one of the first and second printers is physically the same as one of the fast and second reverse side printers.

There is further provided, in accordance with a preferred embodiment of the invention, a method of printing utilizing a plurality of printers, each capable of printing an image on a same side of a web, the method comprising:

printing, by a first printer, of first images, separated by spaces, along a first side of a web; and printing, by a second printer, of second images at spaced positions within the spaces between the first images.

In a preferred embodiment of the invention, in which spaces remain after printing said first and second images, the method includes:

printing, by a third printer, of third images at spaced positions within the remaining spaces.

Preferably, the method includes printing at least one image on the other side of the web.

In a preferred embodiment of the invention printing at least one image on the other side of the web comprises:

printing images, by a first reverse side printer, separated by spaces, along the reverse side of the web; and printing images, by a second reverse side printer, at spaced positions within the spaces between the images printed by the first reverse side printer.

Preferably, where spaces remain after printing by said first and second reverse side printers, the method comprises printing, by a third reverse side printer, of images at spaced positions within the remaining spaces.

Preferably, the images printed on the reverse side are aligned with respective ones of the images printed on the first side of the web. In a preferred embodiment of the invention, the images printed by the first and second printers have different dimensions along the length direction of the web. In a preferred embodiment of the invention different images printed by at least one of the first and second printers have different dimensions in the length direction of the web. In a preferred embodiment of the invention, at least some of the images printed by at least one of the printers are different from each other. In a preferred embodiment of the invention, at least some of the images produced by different printers are different.

In a preferred embodiment of the invention, the images printed by at least some of the printers are multi-color images comprised of a plurality of single color separations. Preferably, each of the separations is sequentially produced and the method includes sequentially transferring the images to an intermediate transfer member; and transferring the images together to the web.

Preferably printing comprises printing using electrostatographic printers, preferably using powder or liquid toner.

BRIEF DESCRIPTION OF DRAWINGS

The invention will be more clearly understood from the following description of preferred embodiments thereof read with reference to figures attached hereto. In the figures, identical structures, elements or parts that appear in more than one figure are generally labeled with a same numeral in all the figures in which they appear. Dimensions of components and features shown in the figures are chosen for convenience and clarity of presentation and are not necessarily shown to scale. The figures are listed below.

FIG. 2 schematically shows a tandem printer suitable for printing on one side of a web substrate, in accordance with a preferred embodiment of the invention.

DESCRIPTION OF PREFERRED EMBODIMENTS OF THE INVENTION

Figure 1:
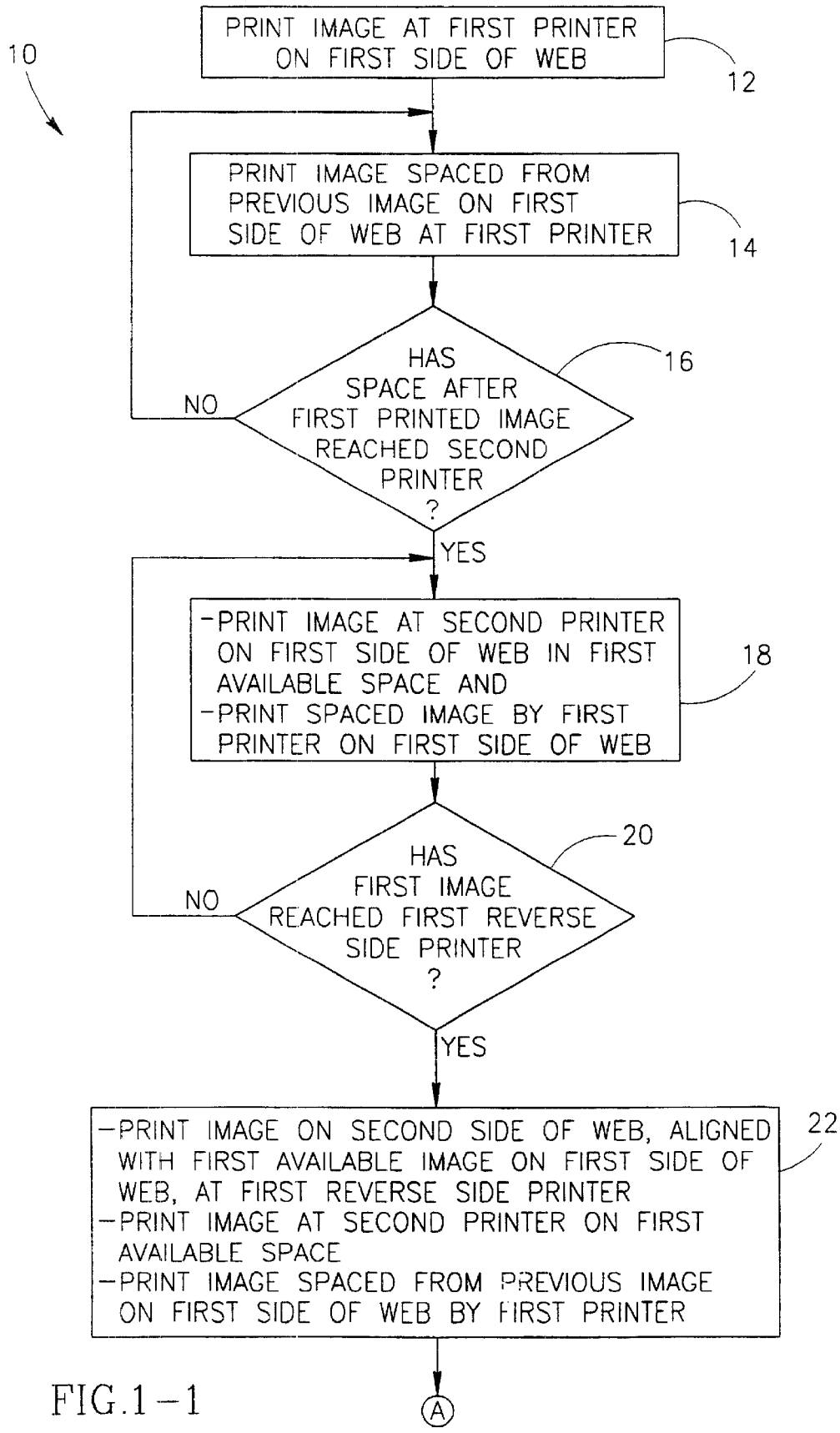
FIGS. 1—1 and 1–2 schematically show a flow diagram of a printing method according to a preferred embodiment of the invention.
Figures 1, 2:
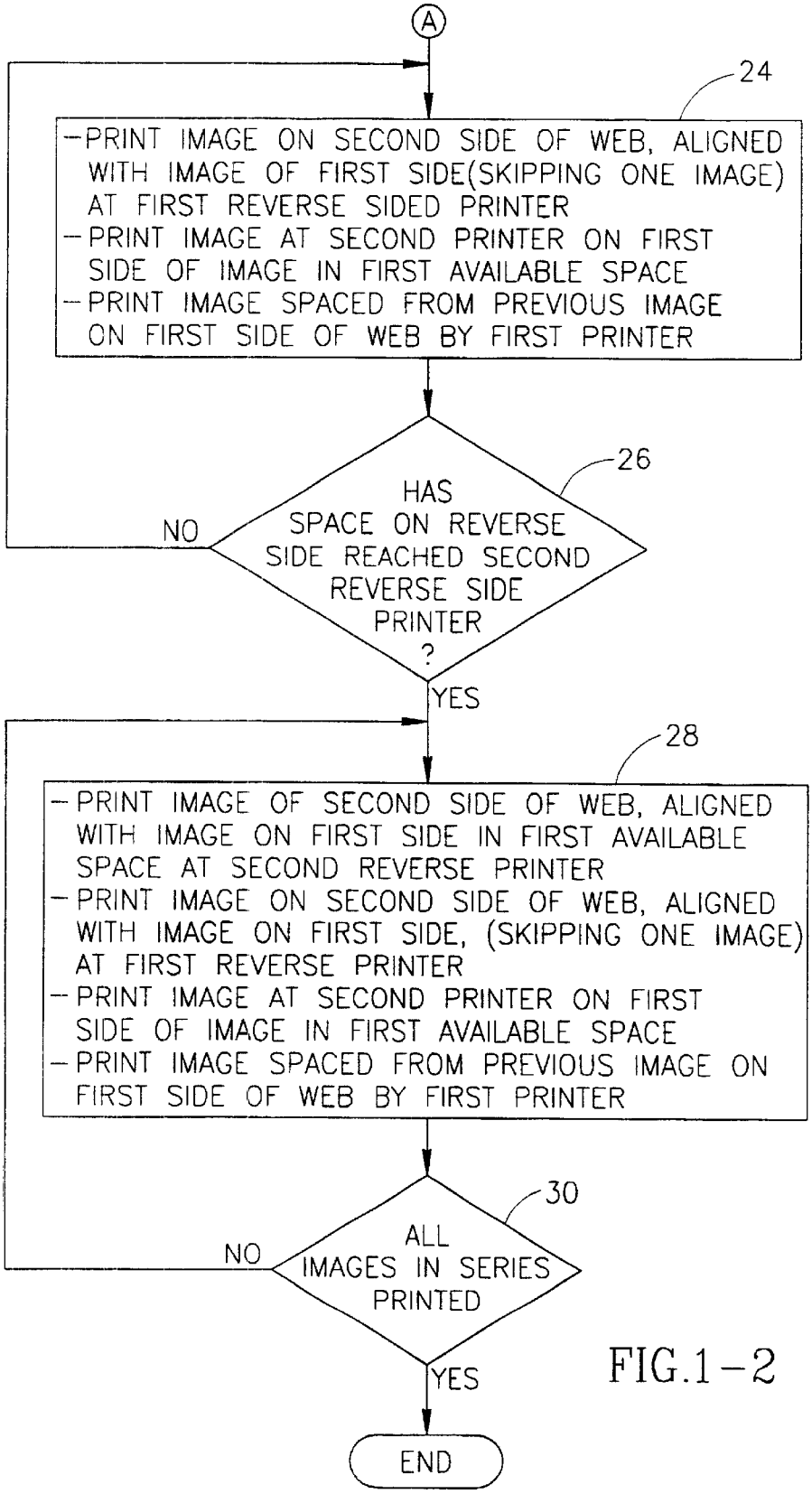
Figure 2:
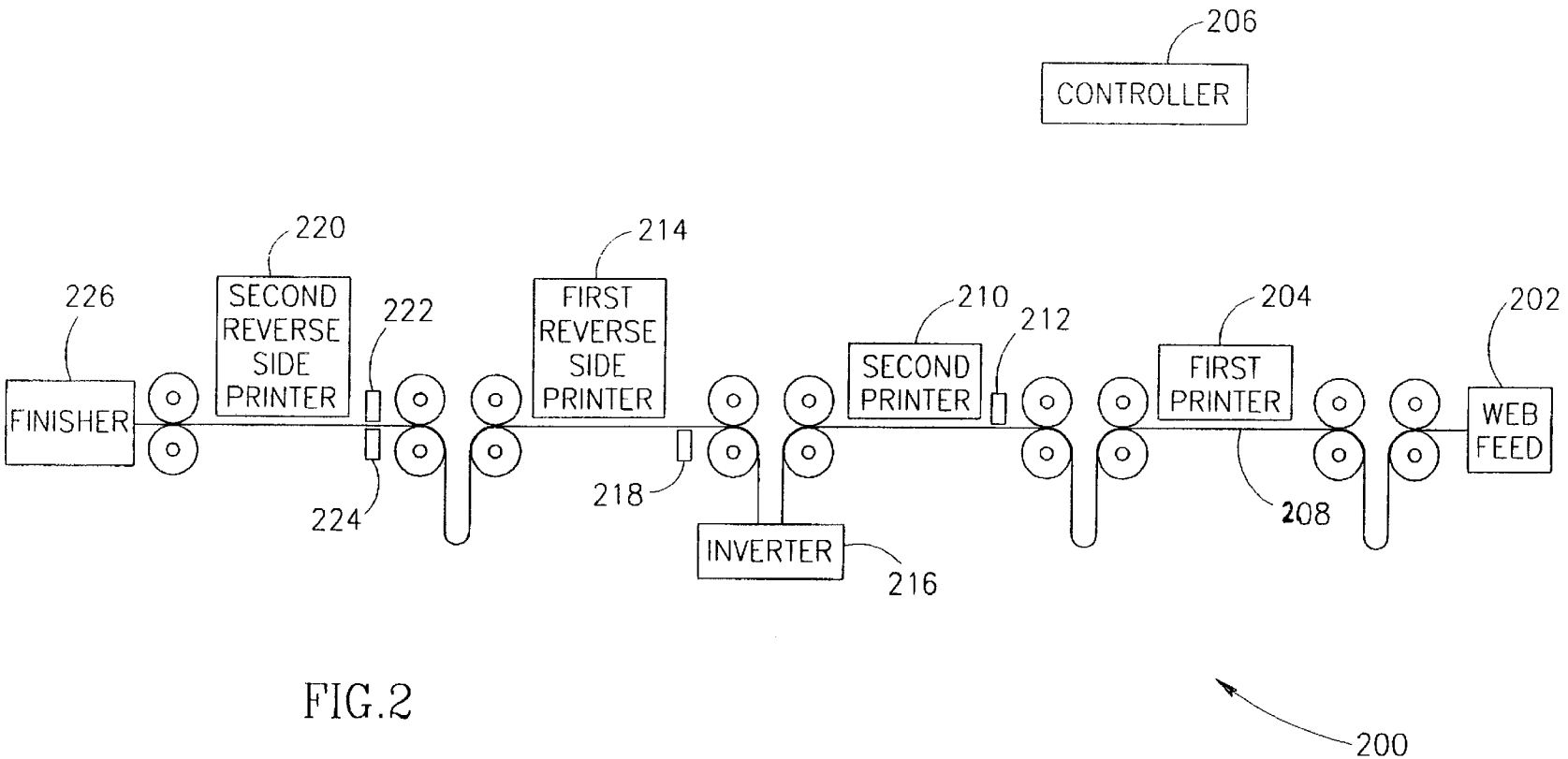

FIGS. 1—1 and 1–2 schematically show a flow diagram of a painting method 10, according to a preferred embodiment of the invention for printing on two sides of a web. FIG. 2 is a generalized schematic diagram of a tandem printer 200, produced in accordance with a preferred embodiment of the invention, suitable for carrying out the method.

Tandem printer 200 preferably includes a web feed 202 which feeds a substrate 208 in the form of a web of material to be printed to a first printer 204 for printing a first series of images on a first side of web 208. Preferably, web feed 202, first printer 204 (and the other printers to be introduced later), the unnumbered mechanisms for transporting web 208 and the other components in tandem printer 200 either send signals to or are controlled by a controller 206. Connections between controller 206 and the other elements of the system are not shown to allow for better visualization of tandem printer 200.

First printer 204 prints a first image on a first side of web 208 (step 12). Web 208 is then advanced to a position at which a second image is to be printed by first printer 204. Preferably, a first,and second images are separated by a space, sufficient for an intermediate image to be printed between the first and second images. The spaced second image is printed (step 14) by the first printer, which repeats the process until the space (or alternatively a space before the first image suitable for printing) reaches a second printer 210. During printing of the first image (as well as at least some of the subsequent images) machine readable position markings are printed together with the images. A position sensor 212, preferably determines the relative position of the first image as it reaches the second printer (step 16) and, preferably via controller 206, coordinates between the position of the web and the printing of an image by second printer 210. Second printer 210 then prints an image in the space between the first two images printed by first printer 204, while printer 204 continues to print spaced images on the first side of the web (step 18). The printing of the images may take place simultaneously or not, although control of the system may be simpler is all printing stations print together. Until the printed images reach second printing station 210, first printing station 204 continues to print spaced images.

It should be understood that if a one-shot printer is used, the actual printing time is generally much shorter than the time required for transfer of the image to the substrate. This will be clear from the discussion of FIG. 3, below. Thus, the web may be moved to its next printing position during the time when the individual color images are being formed and collected on the intermediate transfer member.

The printing of spaced images at the first station and the second station continues until the first printed image reaches a first reverse printer 214. In preferred embodiments of the invention, the web is inverted by an inverter 216, which may have a structure of any of the well known web inverters as known in the art. Alternatively, the printer may have an inverted geometry such that the printer prints on the inverse side of the web. This may be possible, for example if the printer is an ink jet printer in which case the web could be vertical while it is being printed. However, when electrophotographic printers are used, an inverter is preferably used.

When the first image on the first side reaches first reverse side printer 214 (as indicated, for example, by sensor 218, step 20) printer 214 prints an image preferably in alignment with an image (preferably, but not necessarily, the first image) on the first side. The printing of the images on the first side continues as described above. (Step 22) The printing of the images may take place simultaneously or not, although control of the system may be simpler as all printing stations print together.

This printing of one image by each of the first and second printers and by the first reverse side printer continues, with the first reverse side printer printing an image, on the second side, in alignment with each alternate image on the first side. (step 24)

When the printed images reach a second reverse side printer 220 (step 26), printer 220 prints an image on the next available space on the second side, aligned with the corresponding image on the first side. Preferably, the arrival and position of each image is determined by one or both of sensors 222, 224, only one of which need be present. The printing of one image by each of the first and second printers and by the first reverse side printer continues, with the first reverse side printer printing an image, on the second side, in alignment with each alternate image on the first side. (step 28). This is repeated until the all of the desired images are printed. (step 30).

Two efficient methods of stopping the process are possible. In one method, all the printers are stopped together with a stoppage of the paper flow and a next job is started from the stopped position of the system. Alternatively, the printing is stopped in a reverse order, namely, the first printer stops printing first, when all of the prints in the job are finished. Then the paper advances until all the images interleaving the images printed by the first printer are filled. Similarly, the first and second reverse side printers both stop when they have printed all their images. The second method is less paper efficient, since the entire length between the first printer and the output of the system is blank and wasted. However, this method allows for removal of the prints in the first job before a new job is started and also allows for complete physical separation between the jobs.

Preferably, a finisher 226, slits, sheets and collates the images as they leave printer 200.

It should be understood that while duplex printing is described above, single sided printing is also within the broad scope of the invention. Furthermore, it should be understood that the sizes of the images need not be the same and that each image can be a different size. The actual images may be stored in controller 206 or in local controllers (not shown) in each of the printers.

Figure 3:
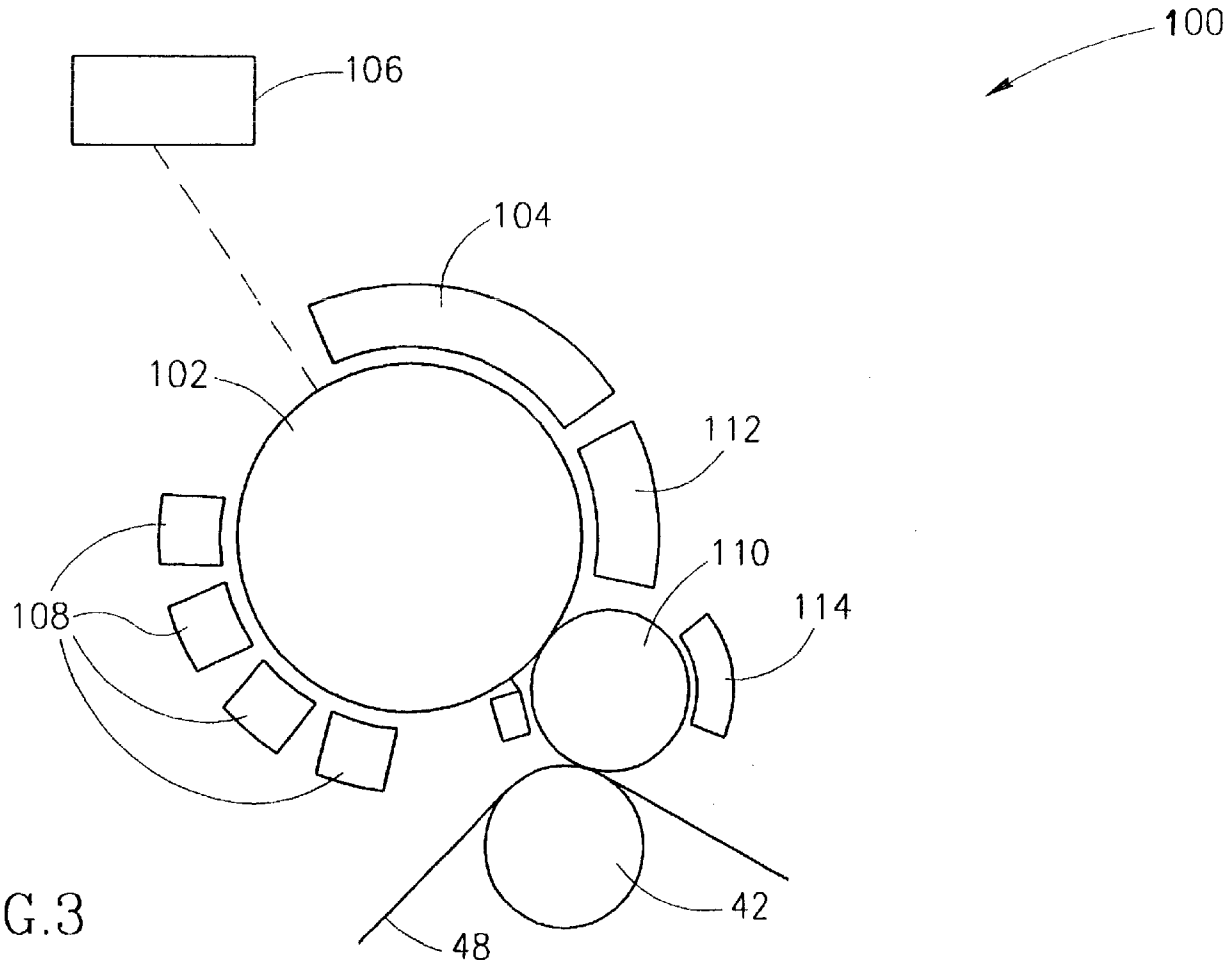
FIG. 3 schematically shows details of a printer especially suitable for use in preferred embodiments of the invention.

FIG. 3 shows an exemplary high speed one-shot printer 100 for use as any one of printers 204, 210, 214 and 220. This system is described in detail in PCT application PCT/IL98/00553. The reader is referred to that application for more details on the operation of the printer.

Printer 100 of FIG. 3, utilizes a single photoreceptor 102 and a single intermediate transfer member (ITM) 110. However, situated about photoreceptor 102 are a plurality of developers 108. Each developers develops an electrostatic image on photoreceptor 102 with a different color image. The images are transferred seriatim to an intermediate transfer member 110. In a preferred embodiment of the invention, web 48 is brought into contact with intermediate transfer member 110 by an impression roller 42 when all the images have been transferred to the intermediate transfer member. In this type of one-shot transfer, the sheet travels at the process speed, but is printed on only once. The developer (which is preferably of the type described in WO 93/01531 or in WO 95/10801) and other components of the printing engine are described with reference to FIGS. 11–13 of the '553 application. Other printers, as for example those shown in FIGS. 2–5 of the '553 application can also be used. The printers described in the '553 application are liquid toner printers. Alternatively, powder toner printers may be used. In a preferred embodiment of the invention, the web is preheated prior to transfer thereto as described in PCT patent application PCT/IL99/00363, filed Jul. 5, 1999, the disclosure of which is incorporated herein by reference.

In a preferred embodiment of the invention, the printer shown in PCT patent application PCT/IL00/00031 filed Jan. 17, 2000, is used as the one-shot printer.

It should be understood that while all of the printers preferably are used to print on a web when the web passes them. However, when one of the printers is inoperative, for so,e reason, the system can continue printing using only the operating printers.

In the description and claims of the present application, each of the verbs, "comprise" "include" and "have", and conjugates thereof, are used to indicate that the object or objects of the verb are not necessarily a complete listing of members, components, elements or parts of the subject or subjects of the verb.

The present invention has been described using detailed descriptions of preferred embodiments thereof that are provided by way of example and are not intended to limit the scope of the invention. The described preferred embodiments comprise different features, not all of which are required in all embodiments of the invention. Some embodiments of the present invention utilize only some of the features or possible combinations of the features. Variations of embodiments of the present invention that are described and embodiments of the present invention comprising different combinations of features noted in the described embodiments will occur to persons of the art. The scope of the invention is limited only by the following claims.

What is claimed is:

1. Printing apparatus comprising:

a first digital printer that prints first images at spaced positions, separated by spaces, along a first side of a web; and a second digital printer that prints second images at spaced positions within the spaces between the first images on the first side.

2. Printing apparatus according to claim 1 wherein spaces remain after printing said first and second images, and including:

a third printer that prints third images at spaced positions within the remaining spaces.

3. Printing apparatus according to claim 1 and including:

at least one reverse side printer that prints images on the reverse side of the web.

4. Printing apparatus according to claim 3 wherein the at least one reverse side printer comprises:

a first reverse side printer that prints images at spaced positions, separated by spaces, along the reverse side of the web; and a second reverse side printer that prints images at spaced positions within the spaces between the images printed by the first reverse side printer.

5. Printing apparatus according to claim 4 wherein spaces remain after printing by said first and second reverse side printers, wherein said at least one reverse side printer comprises:

a third reverse side printer that prints images at spaced positions within the remaining spaces.

6. Apparatus according to claim 4 wherein at least one of the first and second printers is physically the same as one of the first and second reverse side printers.

7. Apparatus according to claim 3 wherein the images printed by the at least one reverse side printer are aligned with respective ones of the images printed on the first side of the web.

8. Apparatus according to claim 1 wherein the images printed by the first and second printers have different dimensions along the length direction of the web.

9. Apparatus according to claim 1 wherein different images printed by at least one of the first and second printers have different dimensions in the length direction of the web.

10. Apparatus according to claim 1 wherein at least some of the images printed by at least one of the printers are different from each other.

11. Apparatus according to claim 1 wherein at least some of the images printed by different printers are different.

12. Apparatus according to claim 1 wherein the images printed by at least some of the printers are multi-color images comprised of a plurality of single color separations.

13. Apparatus according to claim 12 wherein each of the separations is sequentially produced and including:

an intermediate transfer member that sequentially receives the separations and transfers them together to the web.

14. Apparatus according to claim 1 wherein the printers are electrostatographic printers.

15. Apparatus according to claim 14 wherein the electrostatographic printers utilize powder toner.

16. Apparatus according to claim 14 wherein the electrostatographic printers utilize liquid toner.

17. Apparatus according to claim 1 wherein the first and second printers are identical in structure.

18. A method of printing utilizing a plurality of digital printers, each capable of printing an image on a same side of a web, the method comprising:

printing, by a first digital printer, of first images, separated by spaces, along a first side of a web; and printing, by a second digital printer, of second images at spaced positions within the spaces between the first images on the first side.

19. A method according to claim 18, where spaces remain after printing said first and second images, and including:

printing, by a third printer, of third images at spaced positions within the remaining spaces.

20. A method according to claim 18 and including:

printing at least one image on the reverse side of the web.

21. A method according to claim 20 wherein printing at least one image on the reverse side of the web comprises:

printing images, by a first reverse side printer, separated by spaces, along the reverse side of the web; and printing images, by a second reverse side printer, at spaced positions within the spaces between the images printed by the first reverse side printer.

22. A method according to claim 21, wherein spaces remain after printing by said first and second reverse side printers, and comprising:

printing, by a third reverse side printer, of images at spaced positions within the remaining spaces.

23. A method according to claim 20 wherein images printed on the reverse side are aligned with respective ones of the images printed on the first side of the web.

24. A method according to claim 18, wherein the images printed by the first and second printers have different dimensions along the length direction of the web.

25. A method according to claim 18, wherein different images printed by at least one of the first and second printers have different dimensions in the length direction of the web.

26. A method according to claim 18 wherein at least some of the images printed by at least one of the printers are different from each other.

27. A method according to claim 18 wherein at least some of the images printed by different printers are different.

28. A method according to claim 18 wherein the images printed by at least some of the printers are multi-color images comprised of a plurality of single color separations.

29. A method according to claim 28 wherein each of the separations is sequentially produced and including:

sequentially transferring the separations to an intermediate transfer member; and transferring the separations together to the web.

30. A method according to claim 18 wherein printing comprises printing using electrostatographic printers.

31. A method according to claim 30 wherein printing using the electrostatographic printers comprises printing utilizing powder toner.

32. A method according to claim 30 wherein printing using the electrostatographic printers comprises printing utilizing liquid toner.

* * * * *